US005936578A

United States Patent [19]

Driessen et al.

[11] Patent Number: 5,936,578

[45] Date of Patent: Aug. 10, 1999

[54] MULTIPOINT-TO-POINT WIRELESS SYSTEM USING DIRECTIONAL ANTENNAS

[75] Inventors: Peter F. Driessen, Aberdeen; Krishan Kumar Sabnani, Westfield, both of N.J.

[73] Assignee: Lucent Technologies, Murray Hill, N.J.

[21] Appl. No.: 08/587,801

[22] Filed: Dec. 29, 1995

[51] Int. Cl.[6] ..... H01Q 3/02; H01Q 3/12

[52] U.S. Cl. ..... 342/374; 359/118; 332/103; 329/304; 455/65

[58] Field of Search ..... 342/373, 374; 455/65, 506; 359/118; 332/103; 329/304

[56] References Cited

U.S. PATENT DOCUMENTS

| | | | |
|---|---|---|---|
| 4,538,153 | 8/1985 | Taga . | |
| 4,901,307 | 2/1990 | Gilhousen et al. . | |
| 5,095,535 | 3/1992 | Freeburg . | |
| 5,119,104 | 6/1992 | Heller | 342/450 |
| 5,581,260 | 12/1996 | Newman | 342/374 |
| 5,684,491 | 11/1997 | Newman et al. | 342/374 |

*Primary Examiner*—Theodore M. Blum
*Attorney, Agent, or Firm*—Morgan & Finnegan LLP

[57] ABSTRACT

A multipoint-to-point wireless System using directional antennas in an indoor environment. Optical pulses in an asynchronous transfer mode network may be converted into radio pulses, which are transmitted by a radio transmitter to a radio receiver, and then may be reconverted into optical pulses. Transmitter antennas having predetermined beamwidths are used and positioned within the indoor environment for transmitting data signals at a selected carrier frequency. A receiver antenna with a predetermined bandwidth is positioned within the indoor environment for receiving data signals transmitted at the selected carrier frequency. Amplitude Shift Keying (ASK) is used so that the output between transmitted data packets is zero, thereby allowing other users to utilize the system during the gap between the packets.

25 Claims, 9 Drawing Sheets

MULTIPOINT-TO-POINT WIRELESS SYSTEM USING DIRECTIONAL ANTENNAS

BACKGROUND OF THE INVENTION

I. Field of the Invention

This invention relates to wireless data transfer systems designed for indoor use. More particularly, the present invention pertains to multipoint-to-point indoor wireless systems and high speed indoor wireless systems utilizing directional antennas to reduce the amount of multipath rays incident to or received by a receiver.

II. Background Art

High speed computer networks using fibers for Gigabit transmissions between network nodes suffer from a series of disadvantages. In some applications, the cost of installing the fiber may be excessive. In addition, the users of such a system may be mobile and therefore need to be untethered. As such, wireless replacements of the fiber links would serve to be a cost-effective and convenient solution.

The design of high speed wireless systems (i.e. data transmission speeds greater than 150 Mb/s) for indoor use, however, requires the consideration of many factors. A major technical consideration is the presence of multipath rays which result from the deflection of a transmitted signal in an indoor environment, e.g. reflections from the floors, walls and furniture in an office or laboratory or the like. The presence of significant multipath rays degrades a system's performance by adding distortion to the transmitted data signal, thereby resulting in an increased bit error rate and slower data transfer.

To achieve the desired high speeds of data transfer, currently employed indoor wireless systems accept the presence of multipath rays and employ multitone or equalization techniques to remove the multipath rays from the data signals after the signals are received by the receiver. An example of such a system is the Motorola Altair System which is capable of transmitting data at a rate of 3.3 Mb/s. Such a system is disclosed in U.S. Pat. No. 5,095,535, herein incorporated by reference. Even though directional antennas are used to remove the multipath in that system, the beamwidth is about 60°. Thus, it is found that significant multipath does remain so that multitone or equalization techniques to achieve an acceptable error rate are necessary. A drawback of this system, however, is that the use of multitone or equalization techniques, which may be implemented by various electronic designs, not only increases the cost of the overall system but, more importantly, slows the rate at which data can be transmitted. Thus, it would be desirable to provide a high speed indoor wireless system having an increased data transfer rate with negligible multipath effects so that multitone or equalization techniques are not required.

A network in which multiple users communicate with a central station is often referred to as a multipoint-to-point system. In a wireless multipoint-to-point system, data is simultaneously received from a variety of remote users transmitting at varying rates in a mix of stream and burst traffic. As such, it would be desirable to provide a multipoint-to-point wireless system in which some form of medium access control is implemented so that the central station can accept and comprehend data transfer, regardless of such factors as the type of traffic involved and the data transfer rates involved.

SUMMARY OF THE INVENTION

In accordance with the present invention, a multipoint to point data transfer system includes the following: a plurality of remotes, each of the remotes containing a transmitter, each of the transmitters including a directional antenna having a specified beamwidth, each remote positioned to transmit data signals at a selected radio carrier frequency; and a base station, the base station including a receiver in wireless communication with the plurality of remotes, the receiver including a receiver directional antenna with a specified beamwidth, the base station receiving data signals transmitted at the selected carrier frequency from any of the remotes, the beamwidth of the receiver directional antenna being sufficiently narrow and selected to avoid reception of at least substantially all multipath signals, so that the received data signals are substantially error free. In this network, the transmitters of the remotes may be ASK transmitters. The system may also include a converter to convert optical pulses on wired portions of the network into radio pulses, and may also include a converter to convert a radio pulse received from the remotes into optical pulses for use on a wired network.

The present invention is also directed to a method of extending and operating a passive optical network, including replacing fiber links in the passive optical network with millimeter wave radio links, converting optical pulses on wired portions of the network into radio pulses, transmitting the radio pulses over the millimeter wave radio links; and converting the radio pulses into optical pulses for use on wired portions of the network.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PREFERRED EMBODIMENT

DIRECTIONAL ANTENNAS

Figure 1:
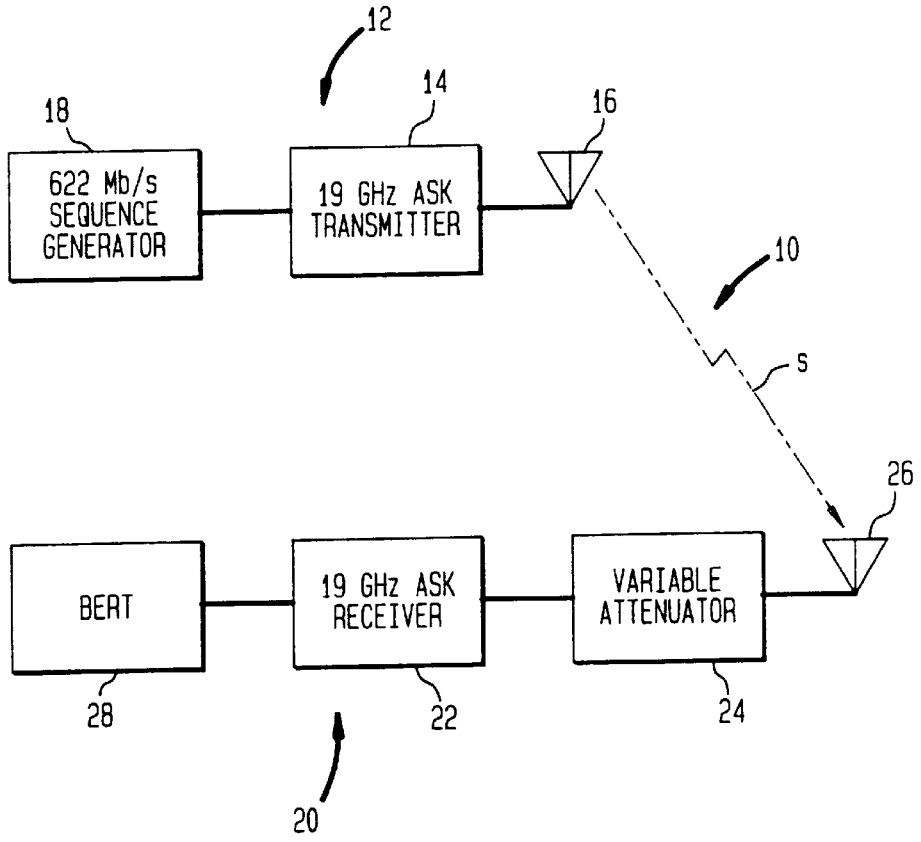
FIG. 1 is a block diagram of a high speed wireless system constructed in accordance with the present invention.

Referring now to the drawings and initially to FIG. 1 thereof, a block diagram of a high speed indoor wireless system is depicted. The system is comprised of a transmitter 12 and a receiver 20. The transmitter 12 includes a source of data, such as a sequence generator 18 for generating a data signal S which is transmitted by a transmitter state 14 via a transmitter antenna 16 having a predetermined beamwidth, as more fully described below. The signal S is received by the receiver 20 through a receiver antenna 26—also having a predetermined beamwidth—and includes a variable attenuator 24, a receiver state 22 and a bit error rate test (BERT) unit 28 for detecting errors in the transmitted signal S. Although an amplitude shift keying (ASK) modulator is depicted in FIG. 1, a frequency shift keying (FSK) modulator or phase shift keying (PSK) modulator may alternatively be employed.

Figure 2:
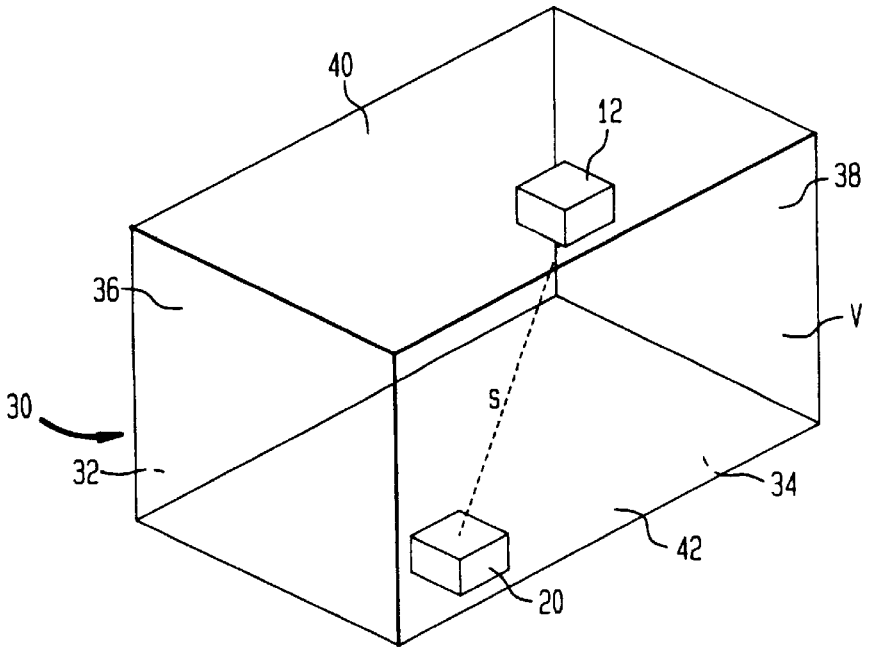
FIG. 2 depicts the relative placement of a transmitter and receiver in a rectangular shaped room.

Turning now to FIG. 2, the system of the present invention is shown employed in a line of site (LOS) system contained within a room or office or other closed volumetric space 30. As depicted, the room 30 has a pair of long walls 32, 34, a pair of short walls 36, 38, a ceiling 40 and a floor 42, and an associated volume V. The transmitter 12 and the receiver 20 are shown mounted at opposite diagonal corners of the room proximate the ceiling 40 and floor 42, respectively.

A problem commonly arising in high frequency data transfer systems is that when a signal is sent by a transmitter, the signal received by the receiver may consist of the original signal plus delayed replicas of that signal which arrive later-in-time via a longer transmission path. The delayed replicas are referred to as multipath rays, whose presence at the receiver stage results in distortion and other unwanted effects.

The presence of multipath rays in an indoor environment, such as the room 30, is especially common in indoor environments which contain numerous objects and surfaces—such as the walls, floor and ceiling of room 30—from which the originally transmitted signal reflects forming multipath rays that degrade the signal ultimately received by the receiver 20. The number of multipath rays in an indoor environment and their power relative to the power of the direct signal S is partially a function of the signal frequency band, the materials or structure of the walls (i.e. concrete, plaster) and the geometry of the room 30 (i.e. square, rectangular). The presence of multipath rays having significant power relative to the power of the direct signal S in an indoor environment causes a notable decrease in system performance in the form of a slower effective or practical data transmission rate.

The present invention is based on a recognition that in line of site (LOS) as well as non-line of site (NLOS) indoor wireless systems, the incidence and effects of multipath rays can be significantly reduced by utilizing highly directional antennas with narrow beamwidths at either the transmitter 12, the receiver 20 or, most preferably, at both. Thus in a LOS system, for example, if the receiver antenna 26 is directed toward the transmitter antenna 16 and has a narrow beamwidth, then so long as the receiver antenna 26 is not positioned at any so-called critical regions in the indoor environment or room 30, as more fully described below, the amount of incident multipath rays received by the receiver antenna 26 will be significantly reduced. A higher data transmission rate can accordingly be achieved without the need for multitone or equalization techniques as in the prior art.

In accordance with the present invention, the optimal beamwidth for the transmitter antenna 16 and the receiver antenna 26 is less than 15°; when such antennas are used, a data transmission rate exceeding 1 Gb/s may be achieved with a minimal bit error rate. Previous systems which utilized beamwidths on the order of 60° suffer from significant multipath problems. Although it is also contemplated that an omnidirectional or broadbeam antenna may be used for only one of either the transmitter or the receiver 12, 20, the reception of multipath rays is most significantly reduced when antennas having narrow beamwidths within the disclosed range are employed at both the receiver and transmitter.

To significantly reduce the reception of multipath rays, the receiver and transmitter antennas must be properly oriented relative to each other. If the antennas 16, 26 are of a fixed type, they may be positioned manually. In the preferred embodiment, the antennas are phased or adaptive arrays, which may be steered electronically. In most cases, the receiver antenna 26 will be directed toward the transmitter antenna 16. However, in some applications, the receiver antenna 26 may be alternatively directed toward a multipath ray transmitted by the receiver antenna 16.

As stated above, even for a system utilizing directional antennas having narrow beamwidths there are still regions in the indoor environment or room 30 at which significant multipath rays exist. These regions are referred to a critical regions; they are present for both LOS and NLOS links in the system and their locations vary as a function of the location of the transmitter antenna 16. The size of the critical region can be evaluated as a function of the antenna beamwidth. For example, and with reference to FIG. 3, the position of the transmitter antenna 16 (shown as T) with respect to the receiver antenna 26 (shown as R) in an indoor environment is depicted. Transmitter antenna T is shown at a vertical displacement and a horizontal displacement $r_c$ (corresponding to the radius of the critical region, as explained below) relative to the receiver antenna R. Transmitter antenna T transmits a LOS signal S as well as a multipath signal S'. Multipath signal S' is transmitted at an angle O with respect to a vertical reference and is reflected at reflection points 43 and 44 as shown. LOS signal S is transmitted at an angle $\phi$ with respect to multipath signal S'. The critical region proximate receiver antenna R is defined as that region for which the image $I_2$ is within the beamwidth $\Phi$ of the receiver antenna 26 that is directed or pointed at or otherwise oriented with the transmitter antenna T. Thus, for a cone-shaped beam transmitted by transmitter T and a relatively small angle $\phi$, the radius $r_c$ of the critical region may be readily calculated. By rotating FIG. 3 in the third dimension, the critical regions may be approximated as cones having a base with a radius $r_c$—which may be located along the floor 42, long walls 32, 34 or short walls 36, 38—and an apex at the transmitter antenna 16. The critical regions for different transmitter locations are depicted, by way of example, in FIGS. 4*a*–4*c*. As shown, the critical regions vary as a function of the location of the transmitter antenna identified as $T_1$, $T_2$ and $T_3$ in FIGS. 4*a*, 4*b* and 4*c*, respectively.

Figure 3:
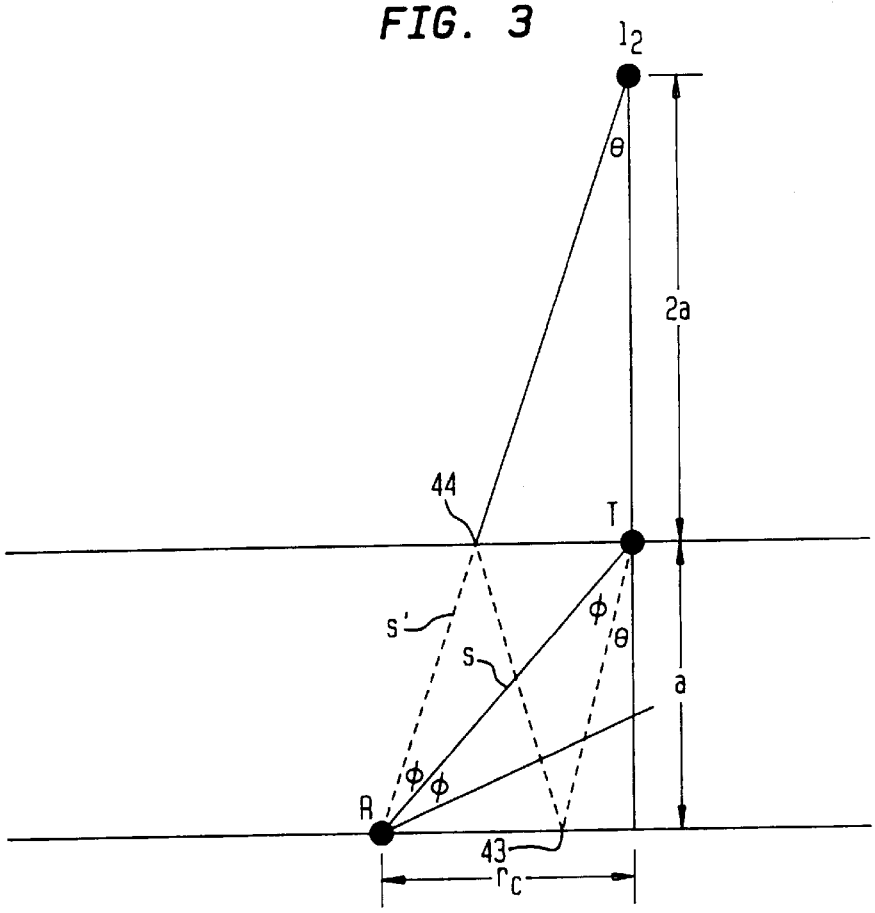
FIG. 3 depicts the geometric positioning of the transmitter and receiver for calculating the critical region.
Figure 4A:
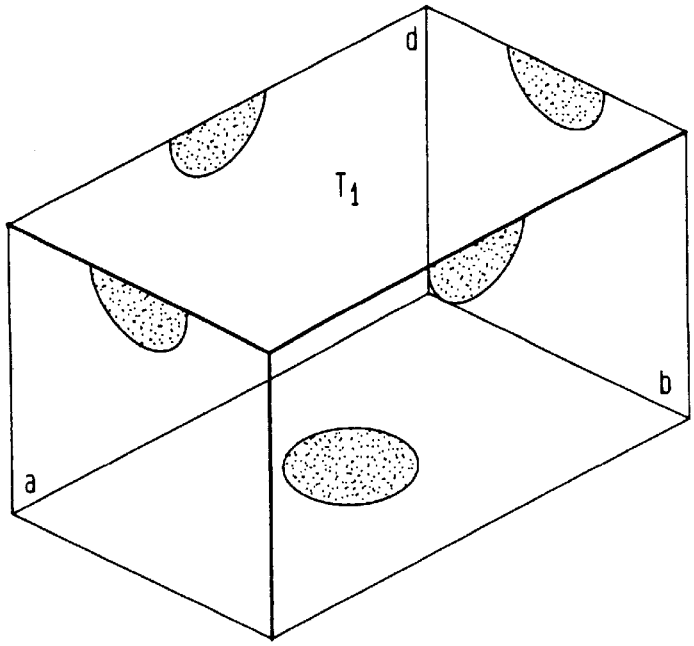
FIGS. 4*a*–4*c* depict the critical regions for different transmitter locations.
Figure 4B:
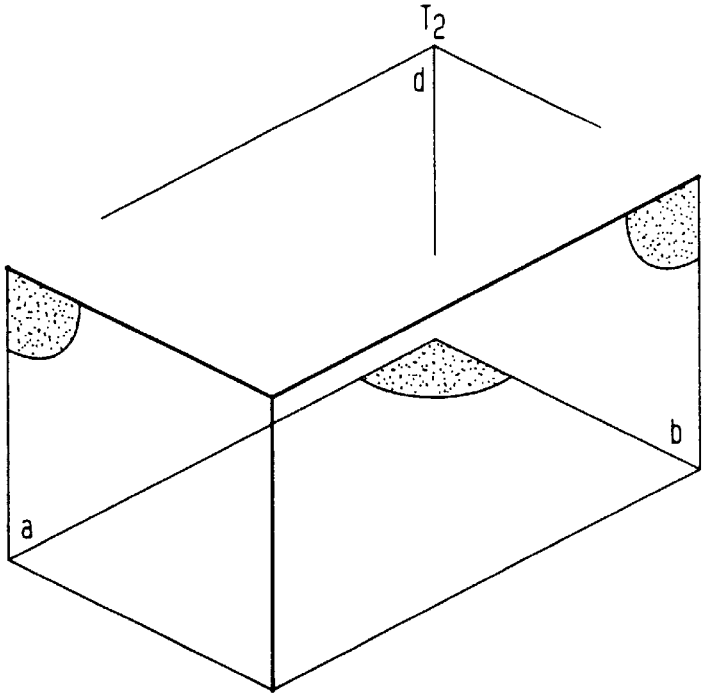
Figure 4C:
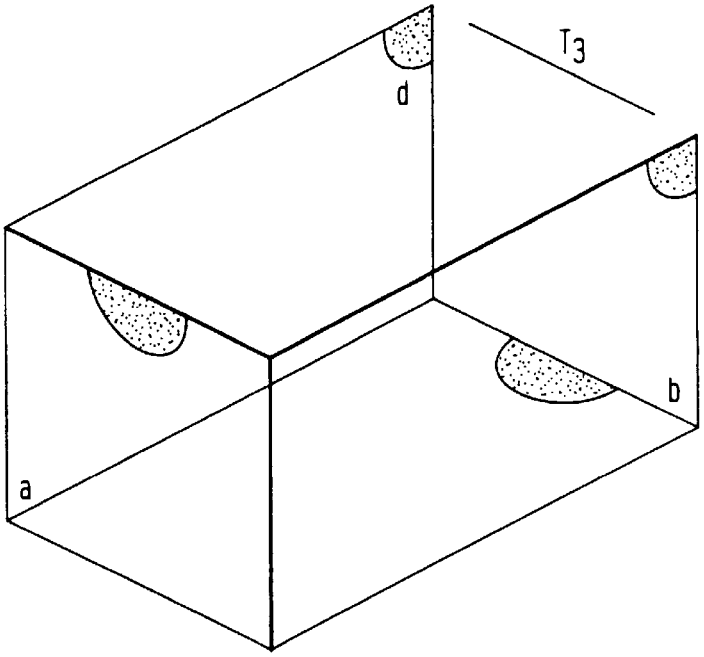
Figure 5:
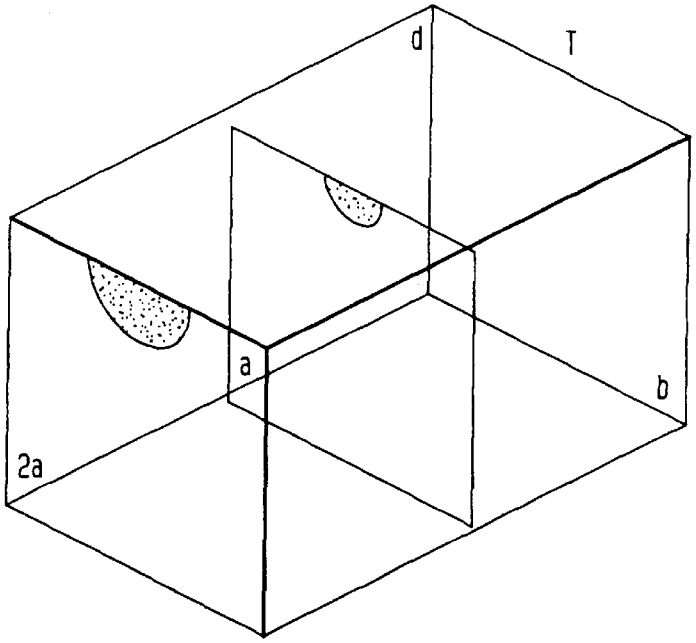
FIG. 5 depicts the critical regions for a particular transmitter location in a non-line of site (NLOS) system.

If the receiver antenna 26 is located within the critical region, then the bit error rate may be unacceptably high, and a link outage (link failure) will occur. However, this will only happen if the reflection coefficients at the reflection points 43 and 44 in FIG. 3 are sufficiently high so that the power in the multipath ray S' is significant.

Having determined the critical region for a desired transmitter antenna location, the fractional outage ratio $O_f$, which is defined as the ratio of the volume of the critical region to the volume V of the space or room 30 containing the transmitter antenna, can be calculated. Thus, for a particular room the fractional outage ratio $O_f$ may for example be calculated for several locations of a transmitter antenna whereby, based on the smallest resulting value of $O_f$, the most suitable locations for the transmitter antenna and receiver antenna can be determined; i.e., the antennas are positioned outside of the critical regions so as to reduce the incidence and reception of multipath rays. In other words, the fractional outage ratio $O_f$ represents the probability that significant multipath rays will exist in any location. By selecting the lowest value for $O_f$, the most efficient location for the transmitter antenna and, correspondingly, the receiver antenna can be determined. It should accordingly now be apparent that using properly placed directional antennas having a narrow beamwidth in a high-speed indoor wireless system will greatly reduce the amount of multipath which, in turn, allows for notably higher data transmission speeds.

The system of the present invention may also be employed for non-line of site (NLOS) links, i.e., where the antennas of the transmitter and receiver are, by way of example, located in separate rooms. For a receiver antenna 26 in NLOS room adjacent to the LOS room containing a transmitter antenna 16, there are several ray paths that potentially contribute to multipath within the critical region. However, it has been found that depending on the value of the power transmission coefficient through the common wall between the LOS and NLOS rooms, and assuming that the two rooms have substantially like dimensions of height, width and depth, then the fractional outage ratio $O_f$ for the NLOS room is only slightly greater than the fractional outage ratio in the line of site room. Thus, a receiver 22 with a narrow beamwidth directional antenna 26 may be positioned in a NLOS room and still receive high speed data transmissions without significant multipath distortion or losses.

The present invention may alternatively be implemented using an omnidirectional antenna, instead of a narrow beamwidth antenna, at the transmitter 12. Employing an omnidirectional antenna in this manner results in the benefit that the directional receiver antenna 26 may be pointed at any image generated by the omnidirectional antenna rather than directly at the transmitter antenna. However, if multiple signal images due to multipath rays fall within the beamwidth of the receiver antenna 26, then distortion or losses will result. The same holds true for an arrangement wherein an omnidirectional antenna is employed at the receiver 20 and a narrow beamwidth antenna is used at the transmitter 12. Thus, by using an omnidirectional antenna at either (but not both) the transmitter 12 or the receiver 20, there are more ray paths which can be exploited to establish a link. However, by using an omnidirectional antenna at the transmitter 12 the effects of objects near the transmitter becomes more pronounced. In particular, additional ray paths will arise from single reflections from walls or objects resulting in multipath which would not occur with a directional antenna at the transmitter. Such multipath may be eliminated by utilizing a broad beam transmission antenna, as opposed to an omnidirectional antenna, having a beamwidth in the range of 90° to 100° and a carefully controlled transmission signal which does not illuminate the immediately adjacent walls or the ceiling of the indoor environment.

Figure 6:
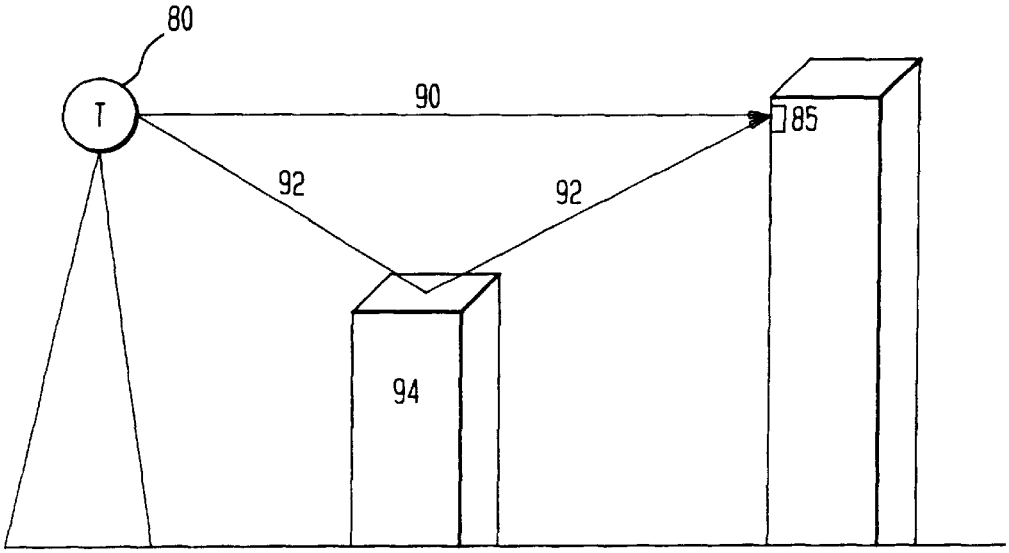
FIG. 6 is a diagram depicting the use of the present invention in an outdoor environment.

It is also to be understood that the present invention may also be utilized in an outdoor environment. With reference to FIG. 6, a transmitter 80 may send signals to a receiver 85 in the form of a line of sight signal 90 and a non-line of site signal 92. The non-line of site signal 92 is reflected off building 94. In the event that either of these signals is blocked, receiver 85 continues to receive a transmitted signal. If both signals are received, a decision is made at the receiver 85 as to which signal is stronger for use.

MULTIPOINT-TO-POINT WIRELESS SYSTEMS

In one embodiment of the present invention, the physical layer of a 622 Mb/sec multipoint-to-point indoor wireless system using directional antennas is implemented, although it is to be understood that other rates may be utilized in accordance with the present invention. One application for this system is as an extension of passive optical networks, by replacing some or all of the fiber links with millimeter wave radio links. In particular, this system may be used as a wireless extension of an asynchronus transfer mode (ATM) passive optical network (PON), such as a 622 Mb/s ATM PON.

In one embodiment of the present invention, a modified PON with a combination of fiber and wireless links is utilized. Optical pulses generated by Amplitude Shift Keying (ASK) on the fiber are converted to radio pulses and vice versa with an ASK burst modem. The millimeter wave ASK radio link with directional antennas (referred to as "Airfiber") may be used for wireless PONs or other applications where radio instead of fiber is to be utilized, such as wireless LANs and point-to-point or point-to-multipoint links.

For Gigabit networks using a tree or star architecture (e.g. for two-way cable TV), the fiber links may be point-to-multipoint. In such networks, e.g. passive optical networks (PONs), a central node can broadcast downstream to all remote users, and the upstream transmission medium is shared among users. At Gigabit data rates, Asynchronous Transfer Mode (ATM) is preferred, in order to accommodate a mix of stream and burst traffic at widely varying user rates. With reference to FIG. 6*a*, a PON system 100, which is designed for two-way cable TV and implemented as a 622 Mb/s ATM PON, is schematically depicted. A central node 105 (referred to as the Line Termination or LT) is connected to other (point-to-point) ATM networks via a V interface 120 (622 Mb/s ATM). The LT is connected via fiber 130 to the user terminals 140 (Network Termination or NT). The NTs 140 send their upstream traffic in bursts to the LT 105, which manages this traffic using a medium access control (MAC) protocol.

Shared medium ATM networks such as that shown in FIG. 6*a* may be very useful in a cellular or personal communications network (PCN), as a backbone to link microcell base stations collocated with the NTs. The possibility of connecting the base stations by radio instead of fiber may facilitate the deployment of cellular and PCN. Shared medium ATM concepts may also be useful for wireless ATM LANs. New millimeter wave frequencies near 38 GHz may be allocated for such radio links in the USA.

Outdoor point-to-point millimeter wave links have been demonstrated at up to 1.2 Gb/sec over distances of upto 23 miles, thus such links would be reliable replacements for outdoor fiber links. Furthermore, indoor millimeter wave radio links can be very reliable at Gb/sec speeds if directional antennas (15 degree beamwidth) and modulation schemes are used. Multipath problems may be virtually eliminated with directional antennas, even in an indoor environment where there are many nearby reflecting objects. Millimeter wave radio links may also be low in cost. A complete FM-based millimeter wave transceiver may cost only a few hundred dollars. An ASK or PSK modem at Gb/sec rates may cost a little more for high speed diodes. Thus the economics of replacing fiber with wireless may be very attractive in many cases. However, Gb/sec point-to-point continuous mode wireless links cannot be used to replace the fiber links of the PON, since the upstream (NT-to-LT) traffic operates in burst mode.

Figure 7A:
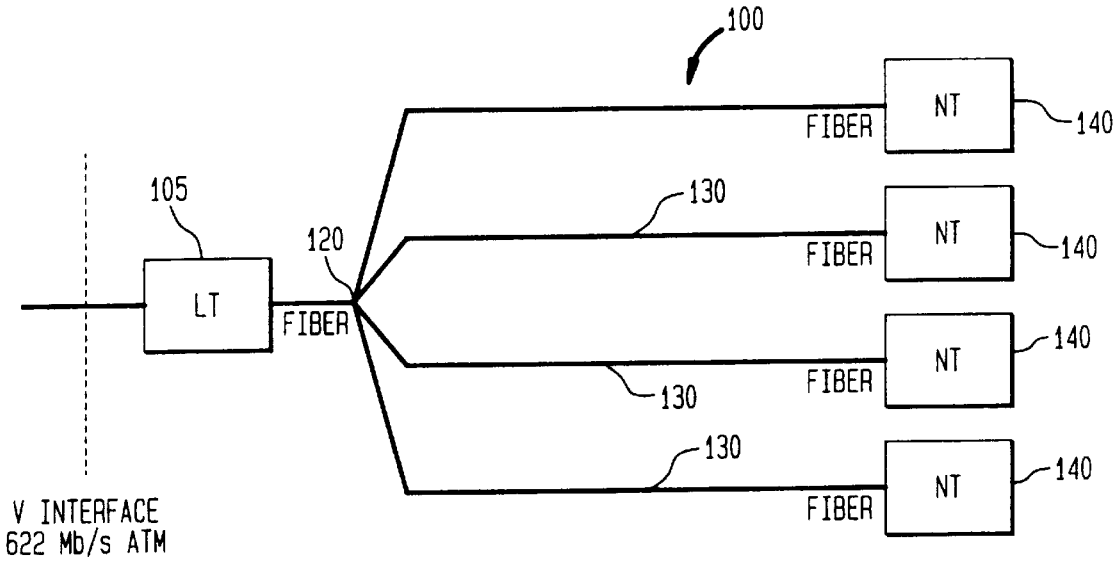
FIG. 7*a* is a block diagram of a wired passive optical network (PON).

In one embodiment of the present invention, a 0.6–1.2 Gb/s multipoint-to-point indoor wireless system with directional antennas, using two 19 GHz ASK burst mode transmitters pointed at a single receiver is used. This system may be used as a wireless extension of the PON shown in FIG. 7*a* or similar networks. In this physical layer demo of the upstream (shared medium) link, the data source for the transmitters is a BERT which generates a data sequence, and the received signals are displayed on a scope. In a system including higher layers, the data sources will be NTs and the receiver will be an LT.

Figure 7B:
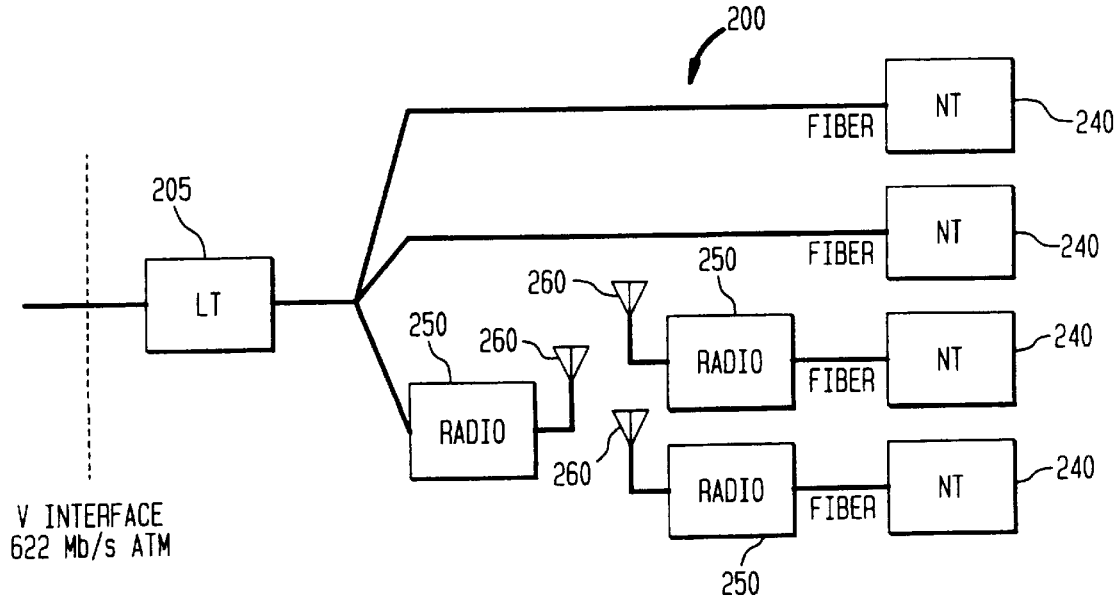
FIG. 7*b* is a block diagram in accordance with the present invention in which radios with directional antennas replace some of the fibers of the wired PON of FIG. 7*a*.

The system is described in the context of the system 200 shown in FIG. 7*b*, but the same general description would apply to any shared medium system. Up to 32 remotes 240 (NT) communicate with a base station 205 (LT) using ATM cells. The LT performs medium access control (MAC) to avoid collisions of ATM cells on the uplink from NTs to LT. The upstream traffic in the PON is managed carefully (using a ranging technique) so that there is only a few bits of guard time between ATM cells arriving at the LT from different NTs. Alternatively, efficiency may be traded for simplicity by allowing a longer guard time.

In one scenario where all of the fiber is replaced by radio, the passive optical combining (Y connection) of the uplink data bursts is replaced by passive radio combining at the base station receiver. In another scenario, as shown in FIG. 7*b*, only some of the fiber is replaced by radios 250 having directional antenna 260. In one embodiment of the invention, the base station 205 may have a multiple beam antenna, or a switched beam antenna to accept all or some signals from one or more of the remotes. In addition, an adaptive antenna array may be used to adaptively reduce the bit error rate to its lowest possible value. The adaptive antenna array may be combined with the function of an adaptive equalizer to jointly reduce the bit error rate.

On the NT-LT uplink, the optical pulses on the fiber generated by the NT are converted into electrical signals which are used to modulate a millimeter wave radio transmitter. In one embodiment, a 19 GHz carrier may be used, although future systems are expected to use frequencies near 38 GHz. Thus, in this embodiment, optical pulses are converted into radio pulses. Electrical pulses from the 19 GHz radio receiver are also converted into optical pulses for the LT receiver. Such optical-electrical and electrical-optical conversions are required in order to be plug-compatible with the fiber of the PON. For a dedicated radio-only network, these conversions, however, may not be necessary. Such optical-electrical and electrical-optical conversions must be achieved without using any explicit knowledge of when packets begin and end, so that the physical layer system need not distinguish between long bursts of 0 bits within a packet and gaps between packets.

To meet this requirement, on-off keying (amplitude shift keying, ASK) is used for the radio, so that the output is zero between packets and also zero for 0 bits. Thus when one user leaves a gap between packets, other users can use it. ASK eliminates the need to "turn the carrier on and off" to send a packet.

Figure 7C:
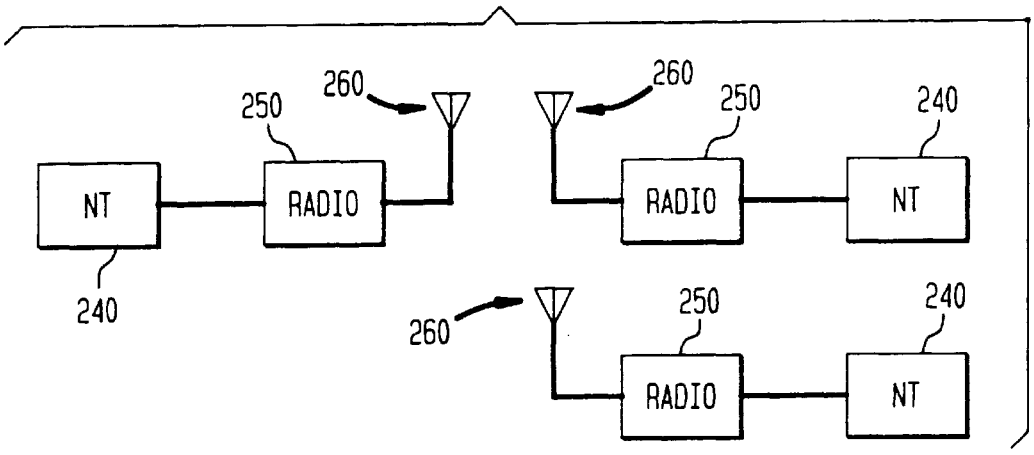
FIG. 7*c* is a block diagram in accordance with the present invention in which radios with directional antennas are used to facilitate two-way communication between plurality of remotes.
Figure 8:
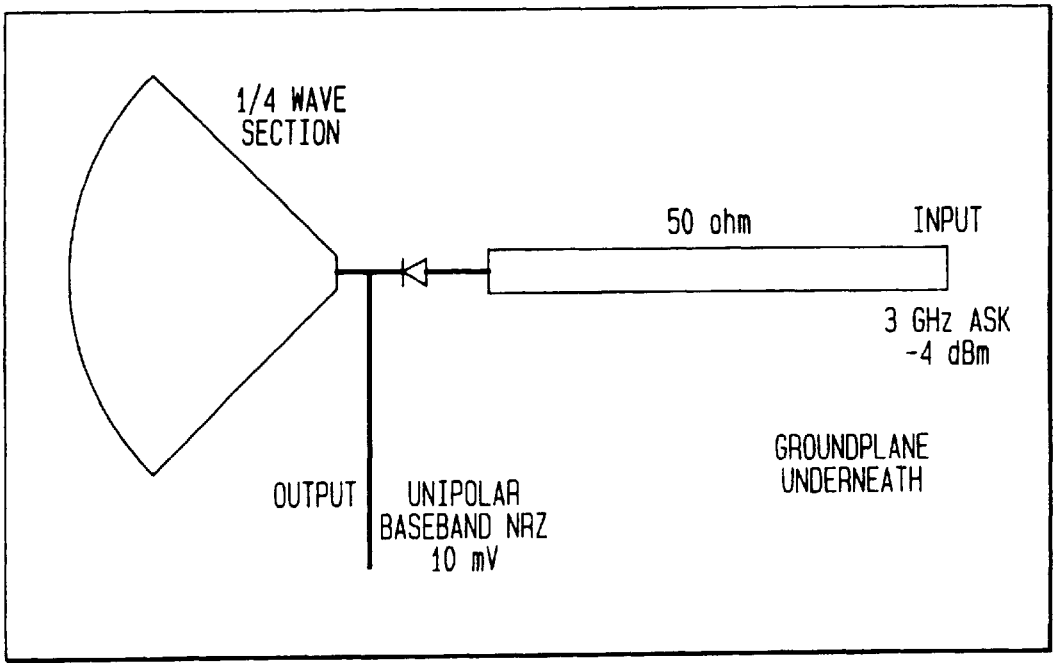
FIG. 8 is a diagram of an ASK detector used in accordance with the present invention.

Such ASK millimeter wave radio links or "Airfibers" can be used to replace fiber links for multipoint-to-point as well as point-to-point systems and multipoint-to-multipoint systems. In particular, as shown in FIG. 7*c*, it should be understood that the instant invention can be utilized in a system in which a plurality of remote stations each contain a transmitter and a receiver, thereby allowing two-way communication between the remotes (without a base station). It is also to be understood that even multipoint-to-multipoint networks degenerate into point-to-point systems (when the number of remotes stations is reduced). As such, it is clear that the present invention is also usable in the point-to-point environment.

An ASK modem is built as follows. The transmitter comprises one mixer which is used to on-off key the data. The diode output was 10 millivolts with −4 dBm input. One critical function required for the ASK modem is an adaptive decision threshold, since the unipolar signal at the diode output may vary in amplitude from burst to burst. This threshold must adapt within the first bit of time of a new burst, noting that there may be only a few bits between bursts of different powers. The circuit described in Y. Ota, R. G. Swartz et al., "High Speed Burst Mode Packet-Capable Optical Receiver and Instantaneous Clock Recovery for Optical Bus Operation", *IEEE Journal of Lightwave Technology*, Vol. 12, No. 2, pp. 325–331, February 1994, herein incorporated by reference, fulfills this function with a power difference between successive bursts up to 20 dB.

Figure 9:
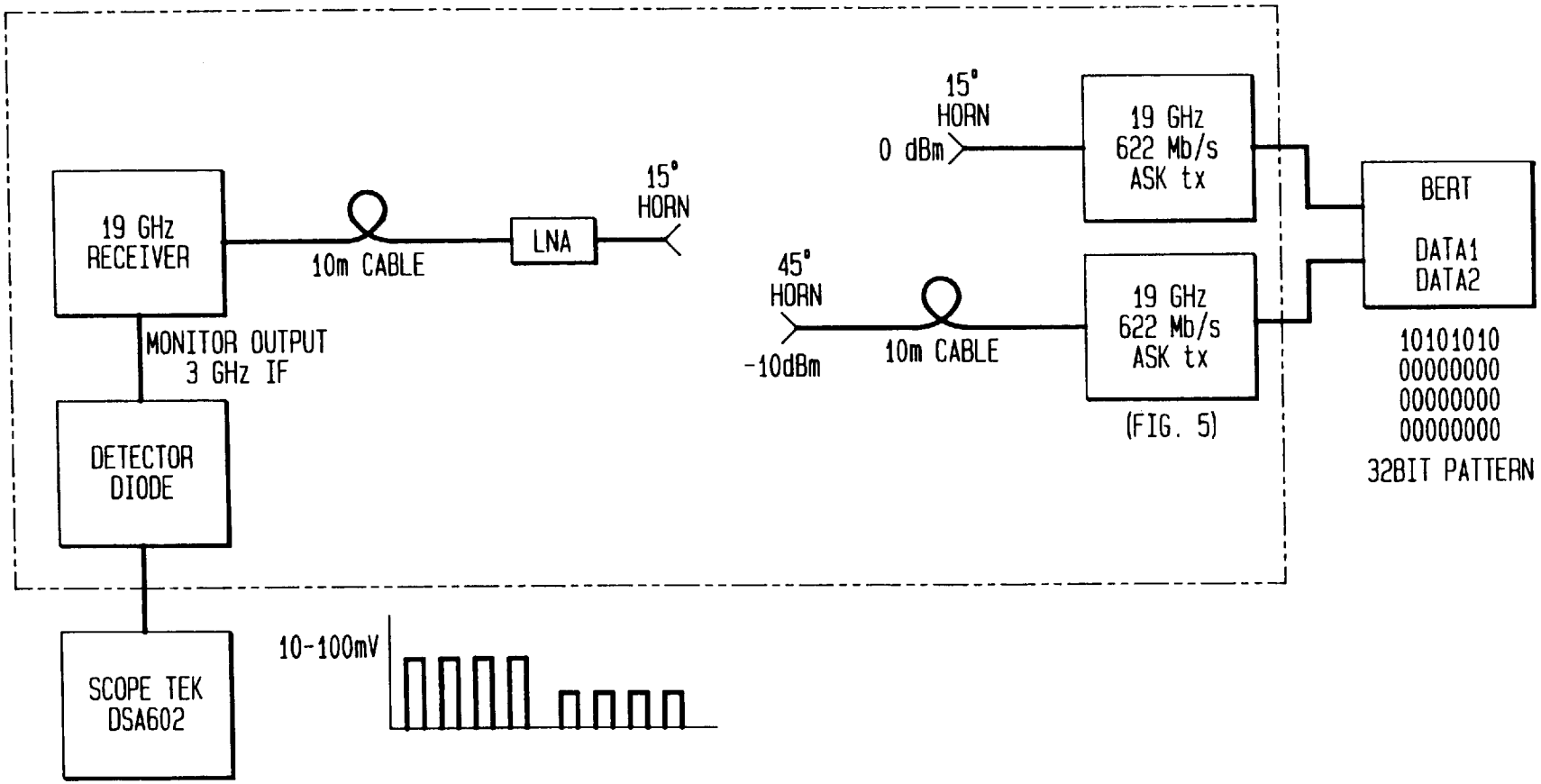
FIG. 9 is a diagram depicting one arrangement of the implementation of the present invention.

In one embodiment of the present invention, a complete experimental setup with two transmitters T1 and T2 and one receiver R, all with directional antennas, as shown in FIG. 9, was set up in the lab. This lab has highly reflective metal walls on all sides, so the antennas were set up to minimize the multipath (by staying out of the "critical regions" where the link runs perpendicular to two reflecting walls). The antennas are horns with beamwidths of 15 degrees at R and T1, and 45 degrees at T2. The different antenna gains and cable lengths for T1 and T2 ensure that the signal powers received at R are different by about 13 dB.

The same BERT was used for both transmitters, with the output set to the 32 bit pattern 10101010 00000000 00000000 00000000 to generate an 8 bit data burst followed by 24 bits of silence to be used by other users. The total path lengths from BERT to receiver input for each of the two T-R links are arranged to be different by adjusting the cable lengths and distances between antennas. This path length difference is arranged so that the 10101010 bursts from T1 and T2 do not overlap at R, i.e. the 10101010 burst from T2 arrives sometime during the 24 0 bits from T1.

Figure 10:
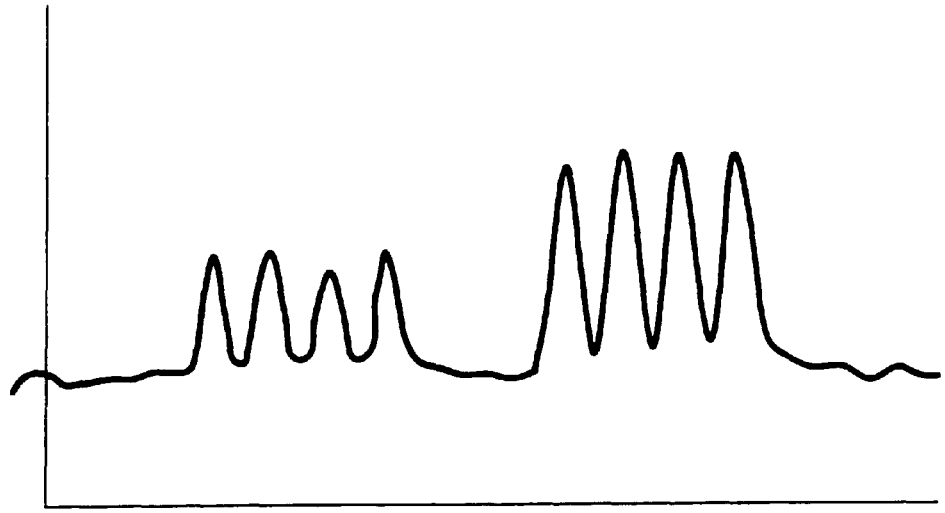
FIG. 10 depicts experimental results of one embodiment of the present invention.
Figure 10:
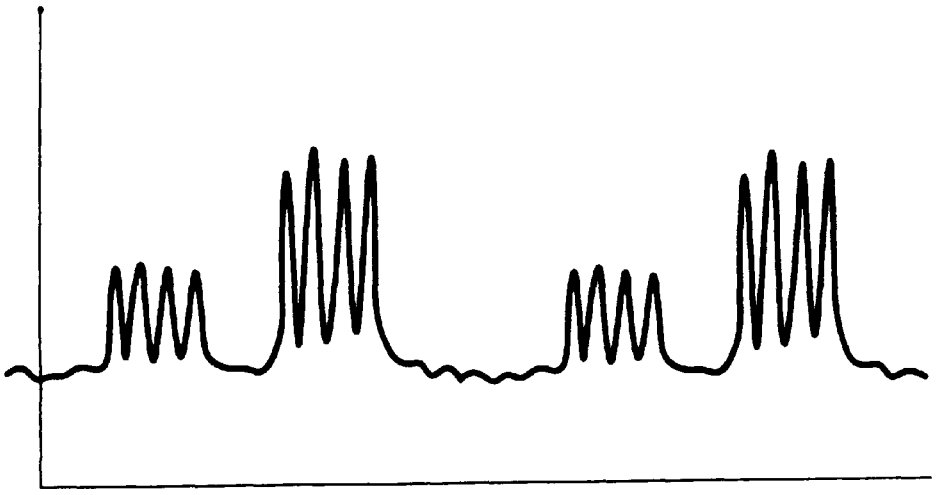

Initial tests using a continuous M-sequence data pattern between T1 and R showed the ASK eye to be open. The key experimental result, as shown in FIG. 10, is the ASK data waveform as observed at the receiver baseband output (after the detector diode). This waveform shows two successive bursts of 8 bits each (10101010) of different powers, with a guard time between them on the order of one or two bits. This guard time can be adjusted by varying the path lengths. The relative powers of the two successive bursts could be easily changed just by pointing one of the T antennas away from R. The data rate could be increased from 622 Mb/s to over 1 Gb/s. The waveform was free of multipath effects except in the "critical regions" where an echo of the data burst could be observed.

A PON system (LT) contains a burst mode receiver as depicted in Y. Ota, R. G. Swartz et al., "High Speed Burst Mode Packet-Capable Optical Receiver and Instantaneous Clock Recovery for Optical Bus Operation", *IEEE Journal of Lightwave Technology*, Vol. 12, No. 2, pp. 325–331, February 1994, which selects the correct decision threshold for each burst and outputs ECL data. Thus the PON system (LT) would receive and decode these signals correctly if they were ATM cells.

Thus, by using ASK, the replacement of fiber with millimeter wave radio is completely transparent to the data, since, at the fiber-radio interface, the optical pulses are simply replaced by radio pulses and vice versa.

In another embodiment of the present invention, the base station contains both a transmitter and a receiver, while the remotes also contain both a transmitter and a receiver. Such an arrangement allows for two-way communication between the remotes and the base station.

Medium Access Control

For the point-to-multipoint radio network, the base station LT broadcasts streams of ATM cells to all NTs (remote terminals). The NTs would share the uplink radio channel by sending bursts of one or more ATM cells, with access regulated by the LT downlink to avoid collisions. Separate frequencies would likely often be used for uplink and downlink.

To avoid collisions between ATM cells on the uplink, a medium access control (MAC) is required. The optimum choice of MAC depends on the number of terminals and the traffic mix. Using a simple MAC (Time Division Multiplexing, TDM) and no ranging, the uplink would consist of a single ATM cell from each of N users, followed by a single cell guard time as follows: 1G2G3G . . . NG1G . . . etc. where each digit represents an ATM cell from that user, and G represents the guard time. TDM is not as efficient as polling or reservation schemes, but may be acceptable for small N.

The LT accepts ATM cells in bursts which arrive at random times. The LT transmitter will add one or more MAC bytes in front of each ATM cell, and the receiver will require a burst mode clock recovery circuit, frame synchronizer and a rate decoupling FIFO. The LT will have to implement the MAC for the terminals. The NT transmits ATM cells from the terminal in bursts at times determined by the MAC.

Figure 11:
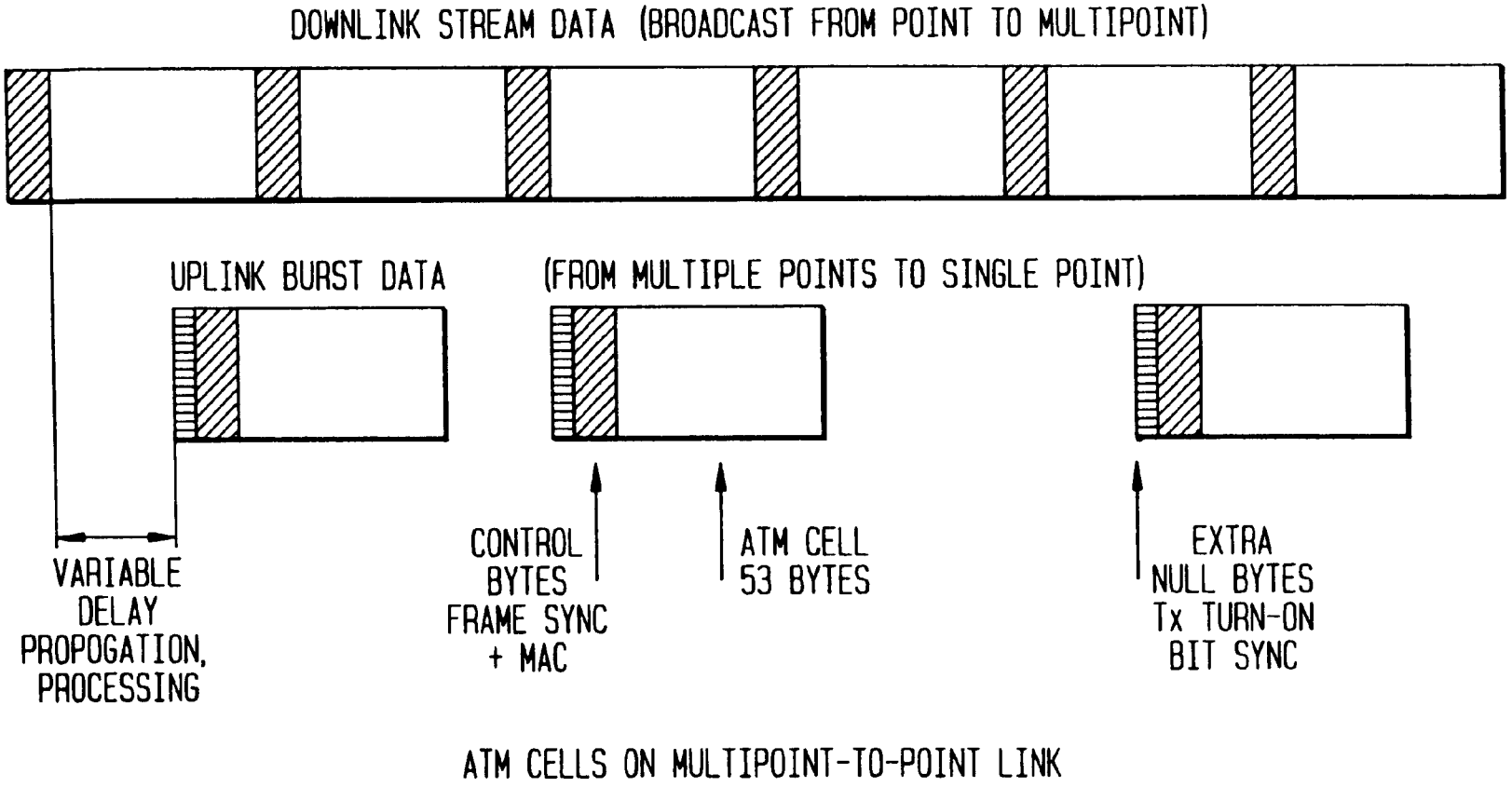
FIG. 11 is a diagram of several ATM cells on a multipoint-to-point link.

There are several approaches for handling the differential delays between remotes broadcasting on the uplink channel. In one scenario, guard times between TM bursts on the uplink may be equal to the length of one frame (a single 53-byte ATM cell plus control and null bytes). Thus the uplink uses only every other frame, in step with the frames on the downlink. This guard time is sufficient to absorb the jitter expected due to radio transmitter turn-on/turn-off times, and different propagation delays. A timing diagram is shown in FIG. 11. The advantage of this approach is simplicity for a first iteration, however it is wasteful of bandwidth. A more sophisticated approach is to perform ranging, i.e. estimate the propagation delay, and instruct the remote to start transmissions at a time such that the required guard time is only a few bits. In this case, the upstream traffic flow looks virtually identical to the flow on the downlink.

While there have been shown and described and pointed out fundamental novel features of the invention as applied to currently preferred embodiments thereof, it will be understood that various omissions and substitutions and changes in the form and details of the devices illustrated, and in their operation, may be made by those skilled in the art without departing from the spirit of the invention. It is the intention, therefore, to be limited only as indicated by the scope of the claims appended thereto.

What is claimed is:

1. A multipoint to point data transfer system comprising:

one or more remotes, each of said remotes containing an ASK transmitter, each of said ASK transmitters comprising a directional antenna with a specified beamwidth and a converter to convert optical pulses on wired portions of a network into radio pulses, each remote positioned to transmit data signals at a selected wireless carrier frequency;

a base station, said base station comprising a receiver in wireless communication with each of said one or more remotes, said receiver comprising a receiver directional antenna with a specified beamwidth and a converter to convert radio pulses received from said one or more remotes into optical pulses for use on wired portions of said network, said base station positioned to receive data signals transmitted at the selected wireless carrier frequency from any of the one or more remotes, the beamwidth of said receiver directional antenna being sufficiently narrow and selected to avoid reception of at least substantially all multipath signals, so that the received data signals are substantially error free.

2. The multipoint to point data transfer system of claim 1 wherein said base station comprises a medium access controller to avoid collision of data simultaneously transmitted from several of said remotes.

3. The multipoint to point data transfer system of claim 1 wherein said receiver of said base station comprises a multiple beam antenna to accept some or all signals from one or all of said remotes.

4. The multipoint to point data transfer system of claim 1 wherein said receiver of said base station comprises a switched beam antenna to accept some or all signals received from one or all of said remotes.

5. The multipoint to point data transfer system of claim 1 wherein said receiver of said base station comprises an adaptive antenna array.

6. The multipoint to point data transfer system of claim 1 wherein said directional antennas of said remotes each have a beamwidth upto 15°.

7. The multipoint to point data transfer system of claim 1 wherein said receiver directional antenna has a beamwidth upto 15°.

8. The multipoint to point data transfer system of claim 1, wherein said system forms an asynchronous transfer mode system.

9. The multipoint to point data transfer system of claim 1 wherein said receiver is configured to receive ASK transmissions from each of said one or more remotes without determining when ASK transmissions begin and end.

10. A multipoint to point data transfer system, comprising:

remote means for ASK transmitting data signals at selected carrier frequencies and for converting optical pulses on wired portions of a network into radio pulses, said remote means comprising directional antenna means; and base station means for receiving said data signals ASK transmitted at selected carrier frequencies and for converting radio pulses received from said remote means into optical pulses for use on wired portions of said network, said base station means comprising a directional antenna means having a beamwidth which is sufficiently narrow and selected to avoid reception of substantially all multipath signals, so that received data signals are substantially error free.

11. The multipoint to point data transfer system of claim 10 wherein said base station means is configured to receive ASK transmissions without determining when ASK transmissions begin and end.

12. A data transfer network, comprising:

a plurality of remotes in wireless communication with one another, each of said remotes comprising an ASK data transmitter and a data receiver, said ASK data transmitter configured to convert optical pulses to radio pulses, said data receiver configured to convert radio pulses into optical pulses, each of said remotes comprising a directional antenna with a specified beamwidth, the remotes positioned to transmit and receive data signals at a selected carrier frequency, said beamwidth being sufficiently narrow to avoid reception of at least substantially all multipath signals so that received data signals are substantially error fee.

13. The network of claim 12 wherein the beamwidth of each directional antenna is under 15°.

14. The network of claim 12 wherein at least one of said remotes comprises a switched beam antenna to accept some or all signals received from one or all of said remotes.

15. The network of claim 12 wherein at least one of said remotes comprises a multiple beam antenna to accept some or all signals from one or all of said remotes.

16. The network of claim 12 wherein said network is an asynchronous transfer mode network.

17. The network of claim 12 wherein said plurality of remotes forms a multipoint to multipoint network.

18. The network of claim 12 wherein said plurality of remotes forms a point to point network.

19. The multipoint to point data transfer system of claim 12 wherein said data receiver is configured to receive ASK transmissions without determining when ASK transmissions begin and end.

20. A method of extending and operating a wired passive optical network, comprising:

replacing fiber links in said passive optical network with millimeter wave radio links;

converting optical pulses on wired portions of said network into radio pulses;

ASK transmitting said radio pulses over said millimeter wave radio links and directional antennas having sufficiently narrow beamwidths to avoid reception of at least substantially all multipath signals so that received data signals are substantially error free, and converting said radio pulses into optical pulses for use on wired portions of said network.

21. The method of claim 20 wherein replacing fiber links in said passive optical network comprises replacing fiber links in a point to point system.

22. A multipoint to point data transfer system comprising:

one or more signal processors;

a converter disposed in communication with said one or more signal processors and configured to convert optical pulses on wired portions of a network into radio pulses;

an ASK transmitter disposed in communication with said converter, said ASK transmitter comprising a directional antenna with a specified beamwidth and configured to transmit said radio pulses at a selected wireless carrier frequency; and a base station, said base station comprising a receiver in wireless communication with said one or more signal processors, said receiver comprising a receiver directional antenna with a specified beamwidth and a converter to convert received radio pulses into optical pulses for use on wired portions of said network, said base station positioned to receive data signals transmitted at the selected wireless carrier frequency, the beamwidth of said receiver directional antenna being sufficiently narrow and selected to avoid reception of at least substantially all multipath signals, so that the received data signals are at least substantially error free.

23. The multipoint to point data transfer system of claim 22 wherein said base station is configured to receive ASK transmissions without determining when ASK transmissions begin and end.

24. A data transfer network, comprising:

a plurality of ASK transceivers, each of said plurality of ASK transceivers configured to convert optical pulses to radio pulses for transmission to another ASK transceiver, each of said plurality of ASK transceivers also configured to convert transmitted radio pulses into optical pulses, each of said ASK transceivers comprising a directional antenna with a specified beamwidth and positioned to transmit and receive data signals at a selected carrier frequency, said beamwidth being sufficiently narrow to avoid reception of at least substantially all multipath signals so that received data signals are at least substantially error fee.

25. The multipoint to point data transfer system of claim 24 wherein said ASK transceivers are configured to receive ASK transmissions without determining when ASK transmissions begin and end.

* * * * *